United States Patent [19]

Gill

[11] 4,001,904

[45] Jan. 11, 1977

[54] KITCHEN UTENSIL

[76] Inventor: Walter L. Gill, 225 S. Buena Vista, Redlands, Calif. 92373

[22] Filed: Feb. 13, 1976

[21] Appl. No.: 658,020

[52] U.S. Cl. ..... 7/14.6; 7/1 A; 81/3.4; 15/209 D

[51] Int. Cl.[2] ..... B67B 7/18; B25F 1/00

[58] Field of Search ..... 81/3.4, 3.34, 3.43, 81/3.1 R; 7/1 A, 14.6; 15/209 D, 104 R

[56] References Cited

UNITED STATES PATENTS

| | | | |
|---|---|---|---|
| 2,083,788 | 6/1937 | Loeber | 7/1 A |
| 2,235,313 | 3/1941 | Cleveland | 81/3.4 |
| 2,375,129 | 5/1945 | Norton | 81/3.4 |
| 2,985,044 | 5/1961 | Gill | 81/3.4 |

*Primary Examiner*—Al Lawrence Smith
*Assistant Examiner*—Roscoe V. Parker
*Attorney, Agent, or Firm*—Imirie, Smiley & Linn

[57] ABSTRACT

A kitchen utensil molded of rubber or flexible synthetic plastic which has a centrally disposed, stepped, hollow frustro-conical jar cap remover that is readily gripped in the palm of the hand, surrounded by a radially disposed, planar flange, the surface of which on the side of the hollow is roughened or otherwise formed for soft abrasive action. The stepped frusto-conical portion can receive different size jar caps and has axially disposed ribs on the cylindrical walls of the step portions for frictionally engaging the rim of a jar cap to facilitate its removal. The frustro-conical portions are capable of nesting with each other in spaced relation so that a plurality of the devices may be gripped and handled simultaneously. In this manner, the utensil may be used as a pot holder with the conical portions preventing slippage between a plurality of the devices and also providing air spaces between the devices for insulating purposes. The roughened flange surface may be used for scrubbing pots or pans especially of the type having linings of Teflon or enamel that may easily be scratched by other types of scrubbers. Finally, the device may be used as a stopper for drain outlets such as in sinks and tubs.

3 Claims, 7 Drawing Figures

KITCHEN UTENSIL

BACKGROUND OF THE INVENTION

A plurality of different types of devices are commonly used as kitchen utensils for individual purposes. For example, U.S. Pat. No. 2,985,044 discloses a jar top remover comprising a molded rubber-like member of stepped frustro-conical configuration with axially extending ribs on the inner surfaces of the cylindrical walls and is very useful in loosening and removing caps for jars and bottles of different diameters. In addition, there are a large variety of pot holders, usually formed of fabric possibly insulated with asbestos, but frequently one of these holders is insufficient to properly insulate a person's hand from the heat of the utensil. On the other hand, two of the holders when used together tend to slip so that they can cause an accident which may result not only in the dropping of the container, but in the loss of the contents and possibly burning or scalding of the user.

Moreover, there are devices such as steel wool and the like that are quite capable of scrubbing food adhering to the inner surfaces of pots and pans, but these devices cannot be used on containers that are lined with Teflon or enamel, which now is in popular usage, because they will scratch the surfaces and render the coatings useless or at least disfigured. Furthermore, the steel wool, sponges and like scrubbing devices are unsanitary because they entrap food particles that are retained even after thorough washing, that can spoil and become contaminated between usage. Various substitute scrubbers that have come on the market are not really efficient for the purpose. Finally, disc shaped stoppers of three or four inches or so in diameter are frequently used for closing the outlets of sinks, tubs or the like, but this is a separate and distinct utensil as are the other three types of utensils.

SUMMARY OF THE INVENTION

The present invention comprises an article composed of rubber or flexible synthetic material and includes a stepped hollow frustro-conical center portion presenting rings of successively reduced diameter for encircling the caps of jars and the like, with the cylindrical walls of the steps having axially extending ribs or the like for frictionally engaging the peripheral surfaces of such jar caps. A relatively planar flange extends radially from the larger end of the hollow stepped portion and the surface of this flange on the open side of the hollow portion is provided with a texture or configuration that presents a soft relatively rough surface for scrubbing the delicate surfaces of containers lined with synthetic plastic or enamel coatings. Thus, the hollow central portion can be used for loosening and removing jar caps whereas the roughened flange surface plus the compressed hollow surface with the ridges thereon will serve as a scrubber for delicate liners in pots and pans.

The frustro-conical hollow portions of a plurality of the members when nested together serves to retain the members in fixed relation and also to provide air spaces between such members so that they can be folded around handles of pots or knobs on covers and the like to insulate the user's hand from the heat of the utensil. Finally, the device is of a diameter of sufficient to cover even large outlets in sinks and tub outlets and, therefore, serves as a stopper.

The present invention is advantageous in that a single device has structural characteristics which combine to perform at least four different operations thereby eliminating the necessity for four different utensils while performing the operations in a superior manner.

DETAILED DESCRIPTION OF THE INVENTION

Figure 1:
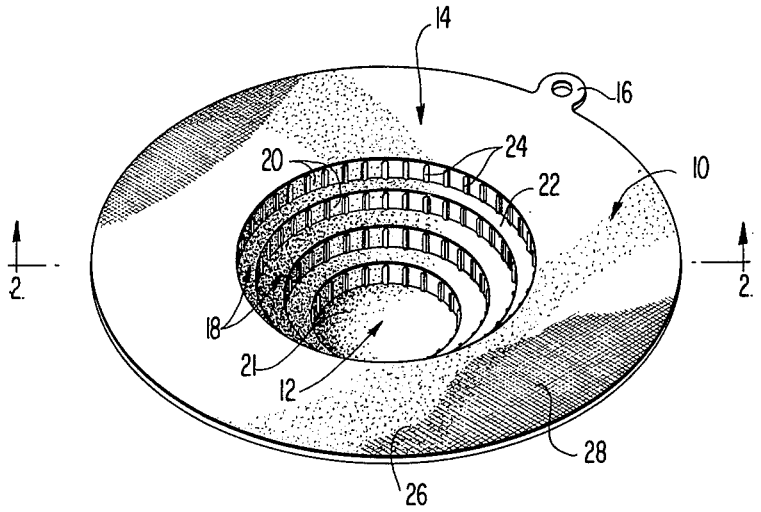
FIG. 1 is a view in perspective of the operative side of a device in accordance with the present invention.
Figure 2:
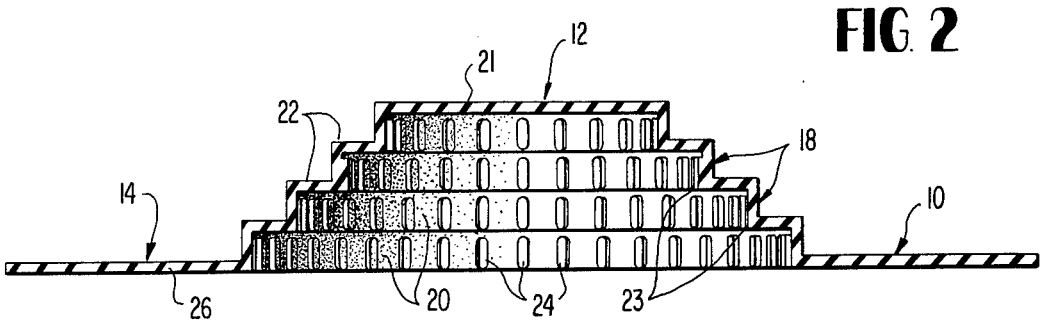
FIG. 2 is an enlarged cross-sectional view taken on line 2—2 of FIG. 1.
Figure 3:
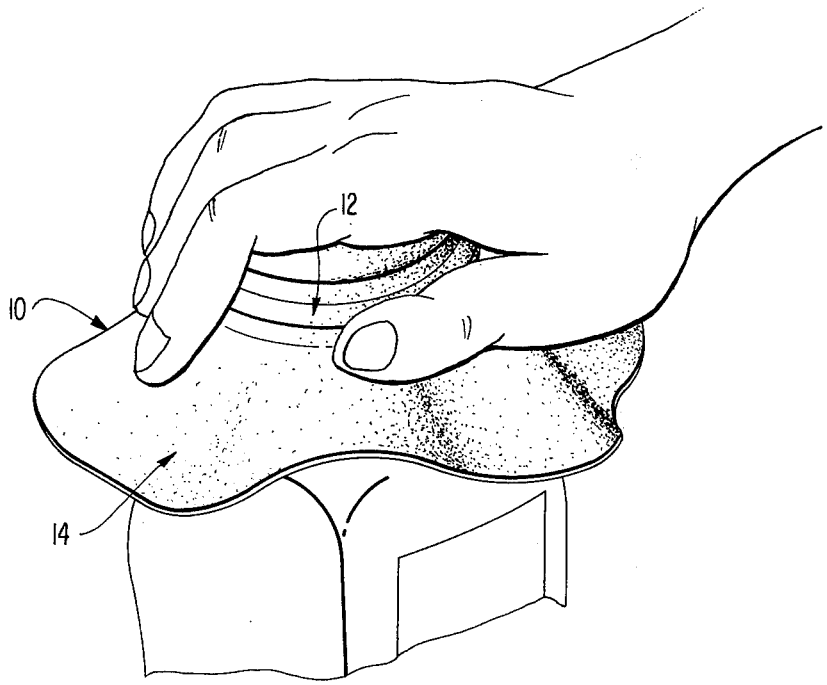
FIG. 3 is a view of the device in use as a jar cap loosener and opener.

Referring now to the drawings, specifically to FIGS. 1–3, a kitchen utensil in accordance with the present invention comprises a body 10 molded of soft or flexible rubber or synthetic plastic and having a central hollow stepped frustro-conical portion 12 surrounded by a relatively wide, generally planar, integral flange 14 extending radially from the larger end of the hollow portion 12. Conveniently, the flange may be provided at its periphery with an integrally molded ring 16 for hanging the device when not in use.

The hollow portion 12 comprises a plurality of step portions 18 each including an axial or cylindrical wall 20 and an inwardly extending, annular, radial wall 22 which is integral at its inner edge with the axial wall 20 of the succeedingly smaller step portion. The hollow portion 12 is closed by a wall 21 which spans the area of the smallest of the cylindrical walls 20. The axial walls 20 are provided with inwardly extending axially disposed, spaced ribs 25 which serve to grip the periphery of a jar cap. The stepped portions 18 are adapted to fit over jar or bottle caps of different diameters, with the stepped portion most closely approximating the diameter of the jar cap nesting thereover. The device then is firmly gripped, as shown in FIG. 3 and compressed by the user's hand, if necessary, to engage the ribs 24 with the periphery of the jar cap. The close engagement of the ribs plus the fact that the rubber or plastic material has a naturally high coefficient of friction causes secure engagement of the stepped portion with the jar cap and enables the user to initially turn the jar cap sufficiently to releasse or loosen it from the jar and if necessary to continue unscrewing the cap until it is completely removed.

Figure 4:
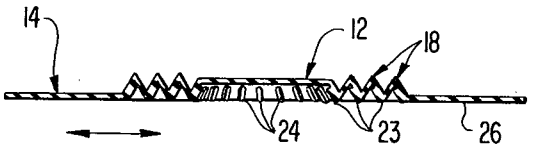
FIG. 4 is a cross-sectional view of reduced dimension similar to FIG. 2, but showing the hollow central portion compressed against a flat surface for use as a scrubber.
Figure 5:
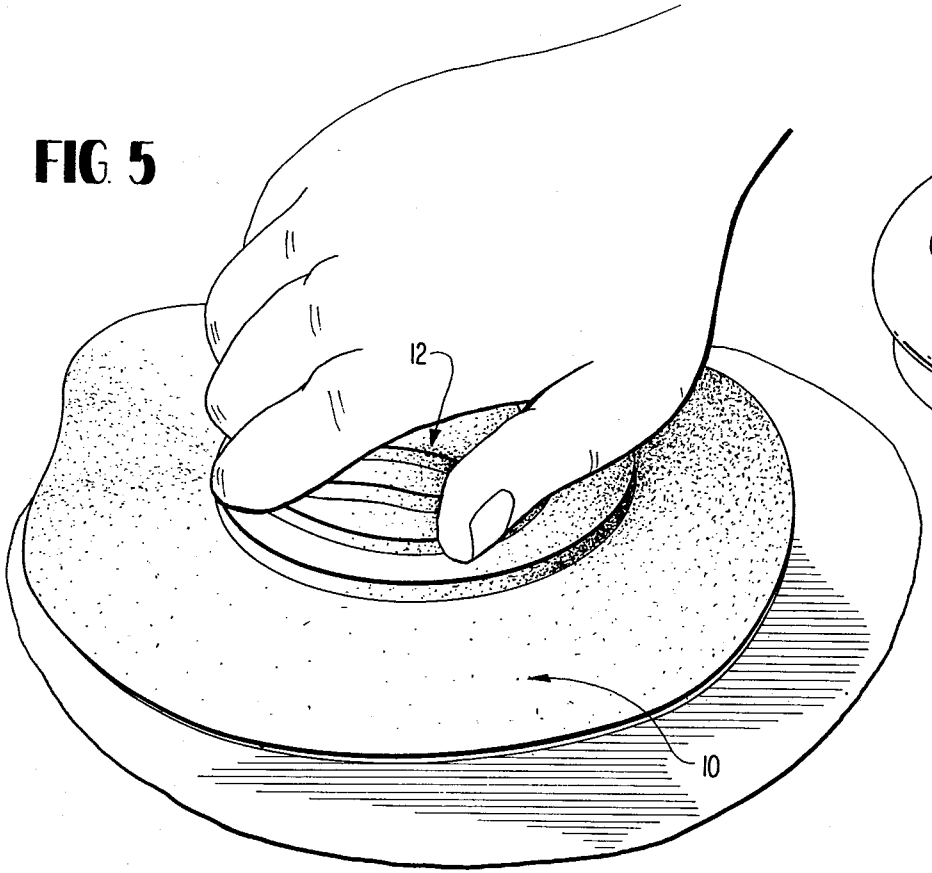
FIG. 5 is a perspective view of the device in compressed condition and in use as a scrubber.

The surface 26 of the flange 14 is provided with a pattern of textural roughness 28, preferably molded therein, that will serve as a scrubber for removing accumulations, such as food particles, from delicate lining surfaces of pots and pans coated with materials such as Teflon or enamel. This type of surface will remove such foreign matter without scratching or otherwise disfiguring the relatively delicate lining of the pot or pan. In use, as shown in FIGS. 4 and 5, the hollow portion 12 may be compressed initially against the surface to be cleaned along with the surface 26 of the flange 14 so that the ribs 24 as well as the sharp inner edges 23 of annular walls 22 within the stepped portion 18 are forced into engagement with the surface. In this position, when the device is rubbed back and forth over the surface to be cleaned, the sharp edges 23 and ribs 24 cooperate with the roughened surface 28 to scrub and remove food and foreign matter from container surfaces without injury to the container lining. After this initial cleaning, the hollow portion 12 may be released to its normal configuration and used as a hand grip for effecting continued cleaning by the action of surface 28 of flange 14.

Figure 6:
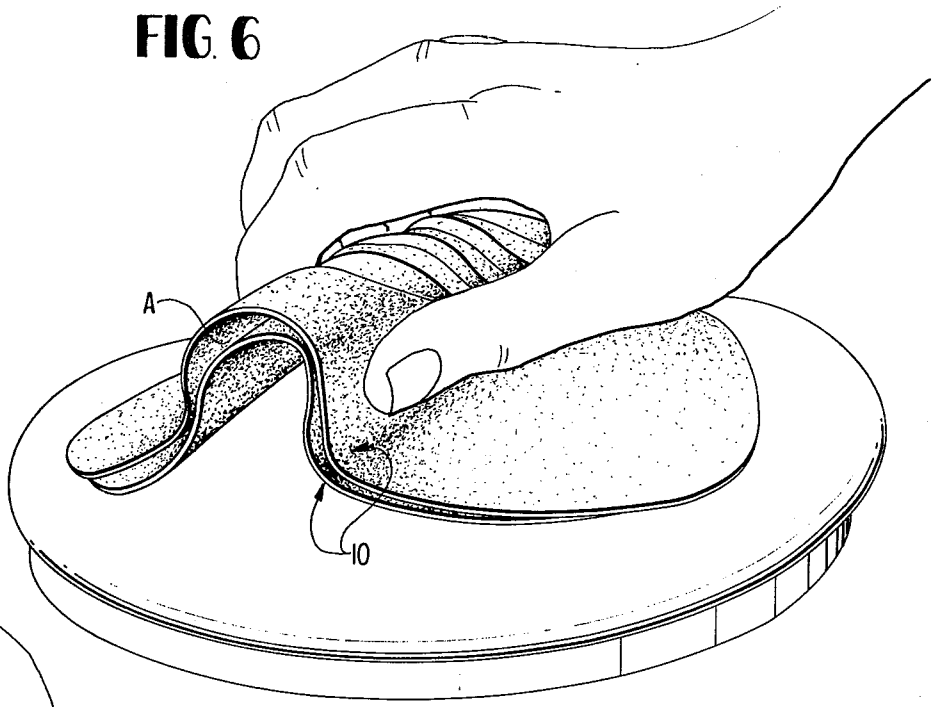
FIG. 6 is a view in perspective of a plurality of the devices nested together by their central hollow portion and used as a pot holder.

The stepped hollow portions 12 of a plurality of the devices can be nested together thereby to secure a plurality of the devices in non-slipping overlapping relationship so that such plurality of devices can be used as a pot holder, as shown in FIG. 6. Not only does the material of the devices serve as an insulation against heat but the devices also define air space A therebetween which serve as additional insulation. Thus, the nested devices can be wrapped around the handle of a container or of a cover therefor and afford extra insulation without danger of slippage.

Figure 7:
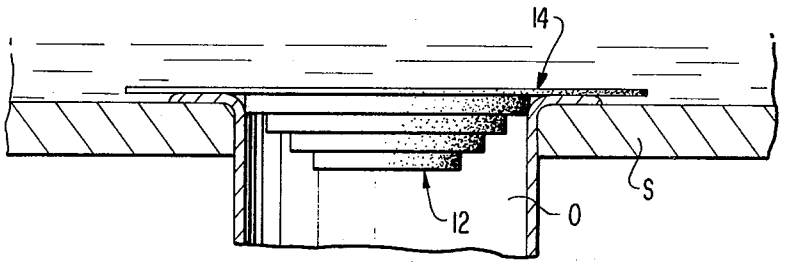
FIG. 7 is a cross-sectional view of the device in use as a liquid outlet stopper.

Finally, the utensil according to the invention, can be used as a stopper for outlets of sinks, tubs or the like, as shown in FIG. 7. In this instance, the device is shown with the conical portion 12 inserted into the outlet opening which is fairly large in diameter, such as the modern sink opening with a strainer, so that the hollow portion 12 serves to center the device while the flange portion 14 overlies the rim or sink base surrounding the outlet. If the outlet opening O of the sink S is of lesser diameter than the diameter of the hollow portion 12, the device can be inverted from the position shown in FIG. 7 so that the hollow portion extends upwardly into the sink area. In either event, the weight of the water on the hollow portion provides a positive seal between the flange 14 and the sink bottom surface.

It can be appreciated that the utensil of the present invention may be made of any suitable material in any number of pleasing colors. Further, preferably during molding of the device, a decorative upper surface texture may be provided to enhance the aesthetic appearance of the overall unit.

Inasmuch as the present invention is subject to many modifications, variations and changes in detail, it is intended that the foregoing description be interpreted as merely illustrative and not in a limiting sense.

I claim:

1. A kitchen utensil comprising a body molded of flexible rubber or synthetic plastic and including a central stepped frustro-conical hollow portion surrounded by a flange extending radially from the edge of the largest diameter of the hollow portion, the stepped portions of the hollow portion including a plurality of axially disposed cylindrical walls having on their inner surfaces axially extending ribs spaced therearound, said walls being connected by radially disposed annular walls between one end of a larger cylindrical wall and the corresponding opposite end of the next smaller cylindrical wall, the steps being arranged in successively smaller diameters and closed by a wall spanning the area of the smallest of the cylindrical walls, the surface of the flange corresponding to the hollow side of the stepped portion defining a pattern of textural roughness thereon to facilitate scrubbing of pots and pans.

2. A kitchen utensil as recited in claim 1 wherein said flange is substantially planar.

3. A kitchen utensil as recited in claim 2 wherein the inner edges of said radially disposed annular walls form together with their respective connected cylindrical walls a sharp edge; and wherein said frustro-conical portion is compressible toward the plane of said flange whereupon said sharp edges of said annular and cylindrical wall connections cooperate with said rough surface of said flange to facilitate scrubbing of pots and pans.

* * * * *